US005195703A

United States Patent [19]

Kais et al.

[11] Patent Number: 5,195,703

[45] Date of Patent: Mar. 23, 1993

[54] DEVICE FOR LOCKING A SWITCH BLADE WITH A STOCK RAIL

[75] Inventors: Alfred Kais, Lich-Eberstadt; Erich Nuding, Aalen; Sebastian Benenowski, Butzbach, all of Fed. Rep. of Germany

[73] Assignee: BWG Butzbacher Weichenbau GmbH, Butzbach, Fed. Rep. of Germany

[21] Appl. No.: 694,547

[22] Filed: May 2, 1991

[30] Foreign Application Priority Data

May 4, 1990 [DE] Fed. Rep. of Germany ..... 4014248

[51] Int. Cl.[5] ..... E01B 7/20

[52] U.S. Cl. ..... 246/443; 246/448

[58] Field of Search ..... 246/358, 415 R, 430, 246/435 R, 438, 439, 443, 448, 452

[56] References Cited

U.S. PATENT DOCUMENTS

| | | | |
|---|---|---|---|
| 3,836,771 | 9/1974 | Berst | 246/448 |
| 4,842,225 | 6/1989 | Carmes . | |
| 4,860,978 | 8/1989 | Durchschlag et al. | 246/448 |
| 4,921,189 | 5/1990 | Callegari . | |

FOREIGN PATENT DOCUMENTS

| | | | |
|---|---|---|---|
| 0295237 | 12/1988 | European Pat. Off. | 246/435 R |
| 320636 | 6/1989 | European Pat. Off. | 246/448 |
| 0320636 | 6/1989 | European Pat. Off. . | |
| 120412 | 3/1900 | Fed. Rep. of Germany . | |
| 1263063 | 3/1968 | Fed. Rep. of Germany . | |
| 2345184 | 3/1975 | Fed. Rep. of Germany | 246/443 |
| 2352017 | 4/1975 | Fed. Rep. of Germany | 246/443 |
| 2450802 | 4/1976 | Fed. Rep. of Germany | 246/443 |
| 2542202 | 3/1977 | Fed. Rep. of Germany . | |
| 2635231 | 2/1978 | Fed. Rep. of Germany | 246/435 R |
| 3838415 | 5/1990 | Fed. Rep. of Germany | 246/443 |
| 358825 | 1/1962 | Switzerland | 246/435 R |
| 456667 | 7/1968 | Switzerland . | |
| 233110 | 5/1925 | United Kingdom . | |

OTHER PUBLICATIONS

Morgenschweis, Otto: Weichen für Schienen-Schnellverkehr. In: Eisenbahningenieur 28, H.3, 1977, S.101-107.

Prospekt der Firma Integra, CH 8304 Wallisellen, Bestell-Nr. HTS 3006/179, eingeg.im DPA Oct. 1979.

*Primary Examiner*—Michael S. Huppert
*Assistant Examiner*—Scott L. Lowe
*Attorney, Agent, or Firm*—Beveridge, DeGrandi, Weilacher & Young

[57] ABSTRACT

A device for locking a switch blade (10, 12) with a stock rail (14, 16) is proposed, whereby the switch blade is held down on a supporting surface only when it is in locked and unlocked positions. When the switch blade (10, 12) is in the locked position it is acted upon by a resultant force (53) that prevents both a rotation of the switch blade and its rising up.

13 Claims, 6 Drawing Sheets

DEVICE FOR LOCKING A SWITCH BLADE WITH A STOCK RAIL

The present invention relates to a device for locking a switch blade that can be supported by its rail foot on a base, with a stock rail including a lock piece that extends from the stock rail, through which can pass a sliding element such as a push rod and a locking element such as a locking clamp that interacts with this reciprocally, and which in its turn is articulated onto the switch blade through a shaft.

In a known device known as a clamp tip lock, the axis of rotation of the locking clamp lies in the plane of the rail foot of the stock rail, so that when in the locked position what is essentially a horizontally oriented resultant force acts on the switch blade. Because of this, there is a danger that the blade will twist, so that the stock rail and the switch blade separate. In addition, because of the type of clamp lock and the manner in which the forces are applied, it is not possible to guarantee that the switch blade will be held down.

When the switch blade slides, it does so on a base that is referred to as the slide chair. The clamp is also supported so as to be able to slide on the sliding element. Because of this, there is a requirement for constant maintenance in order to lubricate those elements that slide one on top of the other and thus to ensure the correct operation and serviceability of the switch lock. U.S.-A No. 4 92189 (EP-A 0 320 636) describes a switch locking system in which an L-shaped locking clamp runs above the rail foot of the switch blade. The resultant force that causes the switch blade to rest against the stock rail, and which passes between the shaft and the locking clamp support that runs beneath the foot of the stock rail, is such that the vertical force component intersects the base on which the switch blade is moved back and forth at such a large distance from the rail foot that the greater the resultant force, the more powerfully the locking clamp pulls the switch blade to the stock rail, and the more the switch blade will be tilted, so that a gap will open up between this and the stock rail.

Further examples, in particular of clamp tip locks, are described in the following: DE-C 120412, DE-B 1 263 063, DE-A 26 35 231, DE-A 25 42 202, DE-A 24 50 802, DE-A 23 52 017, CH-A 456 667, GB-C233 110, U.S.-A No. 4,842,225; Morgenschweis, Otto, "Weichen fur Schienen-Schnellverkehr" (Switches for Railway Rolling Stock), in: *Eisenbahningenieur* (Railroad Engineer) 28, Vol. 3, 1977, p.p. 101–107; and in the brochure published by INTEGRA, CH-8304 Wallisellen, Order No. HTS 3006/179.

Essentially, it is the task of the present invention to so develop a device of the type described in the introduction hereto that it is largely maintenance free. In particular, it is intended that the quantities of lubricants, which are usually required in considerable quantities, shall be reduced. It is also intended to ensure that the switch blade cannot be twisted when it is in the locked position, which is to say that there is no separation of the stock rail and the switch blade. Finally, it is also to be ensured that, at the same time, the switch blade is held down in the locked position.

Essentially, this task has been solved by the present invention in that the rail foot of the switch blade, in both the locked and the open position, is held down on the base and that between these positions is spaced away from the base. It is preferred that a support that extends parellel to the sliding element extend from the switch blade, and that the locking element is supported, so as to be able to slide, relative to the support, and the locking element is similarly supported relative to the locking element, a supporting element such as a roller interacting in the first instance with sections of the support and of the sliding element so as to hold the rail foot down on the base or to separate it therefrom.

The sliding element and the support both incorporate a section that extends approximately horizontally and which lies in a common plane outside this section, the path of the sliding element and of the support being so changed as to form the chamber-like notches for at least one roller of the locking element or the like. This is effected by moving the sliding element along the support so that, as a consequence of this, the sliding element assumes the function of locking, unlocking, and raising the switch blade, repositioning this, and then lowering it.

According to one embodiment of the present invention, when the switch blade is locked, a supporting element such as a roller, which extends on the same side of the switch blade as the shaft of the locking element, is secured in a first chamber-like notch that incorporates a step to hold down the supporting element, this step incorporating, on the rail side, a first section that preferably extends horizontally, and a second, section that extends preferably vertically, the first section being formed by the sliding element and the second section being formed by the support.

When the switch blade is in the open position, a supporting element such as a roller that is on the opposite side of the switch blade can be secured in a second chamber-like notch that incorporates a step to hold down the supporting element, this including, on the rail side, a first section that preferably extends horizontally, and a second section that preferably extends vertically, the first section being formed by the sliding element, and the second section being formed by the support.

It is also possible for the slopes of the sections that form each particular step to vary from the horizontal, or the vertical, respectively.

It is preferred that the connection between the locking element, which is to say the lock clamp, and the switch blade be effected through a locking clamp receiver that, in its turn, incorporates a shaft that extends in the longitudinal direction of the switch blade and which is surrounded in sections, and thus so as to be moveable longitudinally, by a section of the locking element. It is preferred that a rubber bushing be arranged between the section of the locking element and the shaft, so as to provide for some springing of the locking clamp, to the extent that this is desired.

Those elements that are connected to the stock rail or to the switch blade, respectively, should be made as light as possible in order to avoid large acceleration forces.

A proposed solution that is self evident is that a support that extends parallel to the sliding element runs from the lock piece; that the locking element is supported on the support and the sliding element is supported on the locking element; and that at least in the adjacent locked position of the switch blade, the locking element is secured between the support and the sliding element.

According to the present invention, it is intended that the moving parts roll on each other, although they could also slide on each other.

The support serves as a quasi fixed track that is secured rigidly to the stock rail through the lock piece.

The support and the sliding element, which preferably comprise two sections that extend along the side surfaces of the support—but which can, however, be configured as one piece and extend along only one side surface of the support—incorporate sections that extend in different planes and which provide chamber-like notches, depending on the position of the sliding element, within which a roller or sliding element or like-acting elements which proceed from the lock element can be secured when the switch blade is locked or opened, which is to say unlocked, respectively.

According to the present invention, when this occurs, there is a reciprocal interaction between at least one roller, sliding element, or the like, of the locking element and sections of the sliding element or support, such that the foot of the rail of the switch blade is only lowered onto a supporting surface when in the locked or opened position, which is to say in the two end positions. This means that the switch blade is raised after being unlocked, moved when in this raised position, and then, when in the other end position, when it is in the opened position, is once again lowered.

Since the lock piece preferably forms the upper limit for the slide element, in a further embodiment of the present invention there is similarly a preferably rolling support, through, for example, bearings, between these. This can result from an eccentrically supported shaft, which will also mean that the height of the sliding element can be adjusted.

In order to provide for problem-free adjustment of the support relative to the stock rail, without any need for matching the locking clamp and/or the sliding element, the support is secured within the lock piece in such a manner as to be adjustable. A bolt that extends from the lock piece can pass through the support and an eccentric bushing can be arranged between the bolt and the support. As a consequence, this results in an eccentric connection, which permits lengthways adjustment. Changes in length between the supports that are associated with each stock rail and switch blade of a track and the sliding elements can be balanced out in that between the individual elements there is a fishplate connection that incorporates slots, or something similar, between the individual elements, said fishplate connections being preferably of insulating material.

The lock element, such as the locking clamp, preferably incorporates at least two rollers or similarly acting elements that are spaced apart and run on both sides of the axis of rotation of the locking element, each of these interacting reciprocally with the support and also with the parts of the sliding elements that extend along its sides. In this connection, the arrangement of the rollers can be symmetrical or asymmetrical with relation to the axis of rotation, the latter being preferable, in order that favourable effort arms are available when the locking element is moved, in particular from the locked position into the opened position.

It is, of course, also possible to provide the locking clamp with only one arm, which is to say to provide it with only one supporting element or roller without this affecting the features according to the present invention.

The axis about which the locking element can be rotated runs above the rail foot of the switch blade. When the switch blade is closed, the locking element can be secured in a supporting area that runs beneath the foot of the stock rail. A resulting force that is effective as a holding down force and which prevents twisting runs between the axis and the supporting area, the vertical component of this intersecting the rail foot of the switch blade or passing in the immediate vicinity of this. This is an independently innovative feature.

The present invention seeks to ensure that the vertical component of the resulting force prevents the switch blade from tipping when otherwise, as in the prior art, a gap opens up between the stock rail and the switch blade.

Understandably, this avoidance of any tipping cannot only be prevented if the vertical component of the force intersects the rail foot of the switch blade, but also when the component of the force intersects the base in the immediate vicinity of the rail foot.

In particular, it is intended that the resultant force intersect the transitional area between the rail foot and the web of the switch blade, which ensures that the components of the resultant force intersect the switch blade in the area of its rail foot, on the one hand, and on the other in the area of the rail head—indeed the surface that is adjacent to the stock rail—such, that on the one hand, the rail foot is pressed onto the slide chair and, on the other, the rail head is pressed against the stock rail.

The configuration of the components that make up the force vector that is proposed by the present invention is achieved, in particular, if the distance between the axis and the switch blade is kept as small as possible. It is preferred that the distance between the axis of rotation and the proximate surface of the switch-blade web is approximately equal to 0.94 times the height of the switch blade in this area, in which connection the axis runs at approximately 0.56 times the height of the switch blade above the slide chair. In this regard, the distance can, if necessary, be increased by 50 mm or reduced by 20 mm. The distance to the slide chair can vary within ±20 mm. These figures apply, basically, to UIC rails that are 120 mm high.

The measures according to the present invention seek to ensure that the switch blade cannot be tipped when in the locked position, even if major forces are applied to it, and thus cannot be twisted, and that, at the same time, it can be held down securely on the base, which is to say the slide chair, without any additional means.

BRIEF DESCRIPTION OF THE PREFERRED EMBODIMENTS

Additional details, advantages, and features of the present invention are set out in the claims. A preferred embodiment of the present invention is described in greater detail below on the basis of the drawings appended hereto. These drawings show the following:

FIG. 1: a cross sectional drawing of a switch;

FIG. 2: a plan view of the elements that effect the locking and unlocking of the switch;

FIG. 3: a detail drawing of a section of a switch with the switch blade open;

FIG. 4: a section of a switch with the switch blade locked;

FIG. 5: an additional embodiment of a section of a switch with the switch blade open;

FIG. 6: a cross sectional drawing on the line A—D in FIG. 1;

FIG. 7: a cross section through a locking clamp retaining element;

FIG. 8: a plan view of a support element for the switch blade;

FIG. 9: a cross sectional drawing along the line A—A in FIG. 8;

FIG. 10: a locked switch showing the effective force vectors.

DETAILED DESCRIPTION OF THE PREFERRED EMBODIMENTS

The drawings, in which identical elements bear identical reference numbers, shown sections of a switch in which the switch blades (10), (12) with the associated stock rails (14), (16) are to be locked or unlocked. A locked switch blade is shown in the right-hand portion of FIG. 1 and in FIG. 4 and FIG. 10, and an open switch blade is shown in the left-hand portion of FIG. 1 and in FIGS. 3 and 5.

Figure 6:
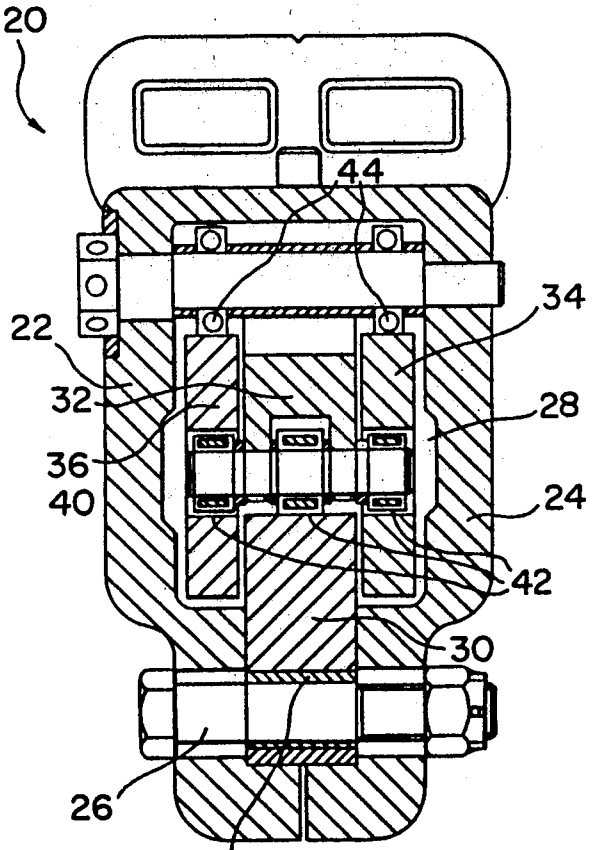

Lock pieces (18) and (20) run from the stock rails (14), (16), and of these, the lock piece (20) shown in FIG. 6 is at enlarged scale. The lock piece (20) comprises two vertical arms or cheek pieces (22) and (24), through which a shaft or bolt (26) passes at the base so as to fix the cheek pieces (22), (24) to each other. Between the cheek pieces there is a space (28) within which is fixed a support (30) and within which there is a moveable locking clamp (32), as well as two sliding elements (34) and (36) that extend along the sides of the support (30) and which together form a push rod or a slide (38).

In order to make it possible to move the support (30) longitudinally, the bolt or the shaft (26) passes through the support (30). Between the drilling in the support (30) and the bolt or the shaft (26), respectively, there is an eccentric bushing (39) so that the support can be displaced as a function of the position of this eccentric bushing (39).

In FIG. 6, the upper horizontal surface of the bearing (30), which bears the reference number (40), serves as a quasi-running surface for the locking clamp (32) that is supported relative to the surface (40) through rolling elements such as bearings (42). The rolling elements or sections thereof or supporting elements (42), respectively, extend to the sides beyond the running surface (40) so as to provide the possibility for the sliding element parts (34) and (36) to provide rolling support. On top, the sliding element parts (34) and (36) are also supported so as to be able to roll on a horizontal rolling element or bearing (44). This means that all of the elements that can be moved relative to each other, which is to say the sliding element (38) relative to the lock piece (20), the sliding element (38) relative to the locking clamp (32), and the locking clamp (32) relative to the support (30), i.e., the running surface (40), are supported so as to be able to roll. This results in a largely maintenance-free locking system, because all of the moving parts roll over each other, as opposed to sliding over each other. A consequence of this is that the quantities of lubricants that were formerly required are now no longer necessary. Of course, it would be possible to use a sliding motion whilst retaining the advantages described heretofore. This is particularly the case if suitable sliding substances are used or are made available. However, in future, reference will always be made to rolling elements, which should also be taken to understand sliding elements or elements that work in a similar or approximate manner, without restricting the scope of the present invention thereby.

The bearing (44) can extend from an eccentrically supported shaft in order that the sliding element (38) can be adjusted for height.

Figure 7:
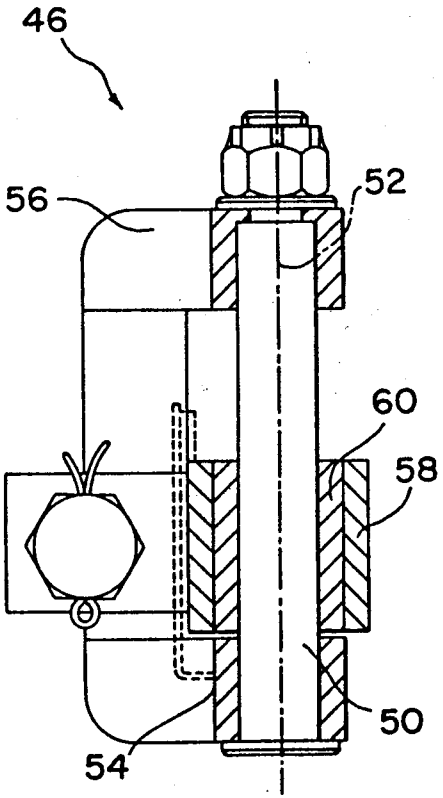

The locking clamp (32) is connected to the rail foot (48) of the switch blade (10) through a locking clamp receiver (46). The locking element receiver (46) incorporates a shaft (50) that extends in the longitudinal direction of the switch blade, which establishes the axis of rotation (52) for the locking clamp (32). The shaft (50) is held by the cheek pieces (54) and (56) that extend from the part of the locking element receiver (46) that is connected to the rail foot (48). The length of the section (58) of the locking clamp (32) that encloses the shaft (50) is shorter than the unattached length of the shaft (50) itself, as is shown clearly in FIG. 7. This means that the locking clamp (32) can move along the shaft (50). In addition, between the section (58) and the shaft (50) there is a sturdy rubber bushing (60) in order to provide springing of the locking clamp (32) relative to the switch blade (10), to the extent that this is desired.

The locking clamp (62) that is associated with the switch blade (12) and its connection are of the same construction as the locking clamp (32), so that no more detailed description of this is required at this point.

As can be seen from the drawings, the locking clamp (32) comprises a first section (64) that incorporates the section (58) and extends approximately vertically and which becomes the second and third sections (66) and (68) that are of different lengths, which extend essentially horizontally and which have at their ends the supporting elements, which are in the form of rolling elements (42) or (70), respectively, that interact reciprocally with the support (30) and the sliding element (36).

Although, in the embodiment shown, the rolling elements (42) and (70), or corresponding elements that work in the same way, are arranged at the ends of the arms (66) and (68), this is not an essential feature. On the contrary, the rollers can be secured in other areas of the arms. It is also possible to use only one roller (42) or (70).

Because of the fact that the rollers (42) and (70) are arranged asymmetrically in relation to the axis of rotation (52), there are different effort arms, and these are advantageous for locking or unlocking the switch blade (10). However, this does not mean that a symmetrical arrangement of the rollers (42) and (70) relative to the axis (52) is not possible.

Figure 2:
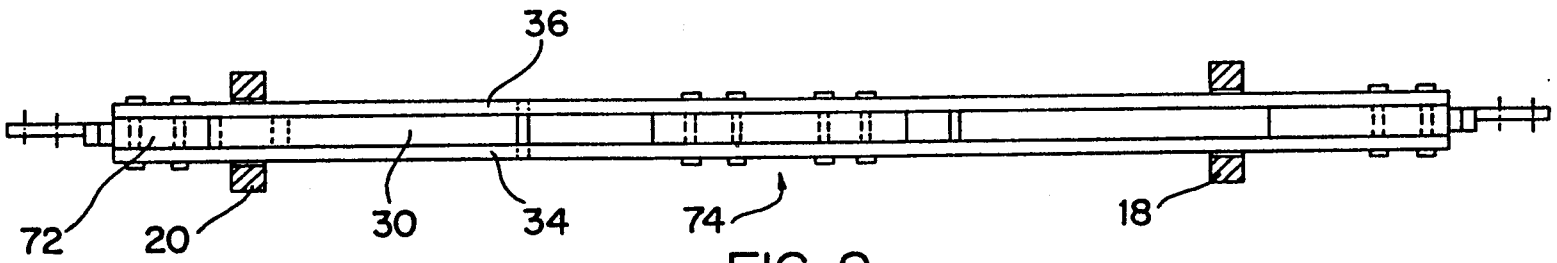

It is plain from the plan view shown in FIG. 2, as well, that the sliding element (38) is made up of the parts (34) and (36) that extend on the sides of the support (30). On the outside, the parts (34) and (36) are connected by bolts or similarly effective elements, and spaces (72) are used to set the distance between the parts (34) and (36). The slide (38) is connected to a drive system (which is not shown in greater detail herein) in order to ensure the movement of the support (30) and thus movement of the locking clamp (32) and the locking or unlocking of the switch blade (10) that results from this.

Figure 1:
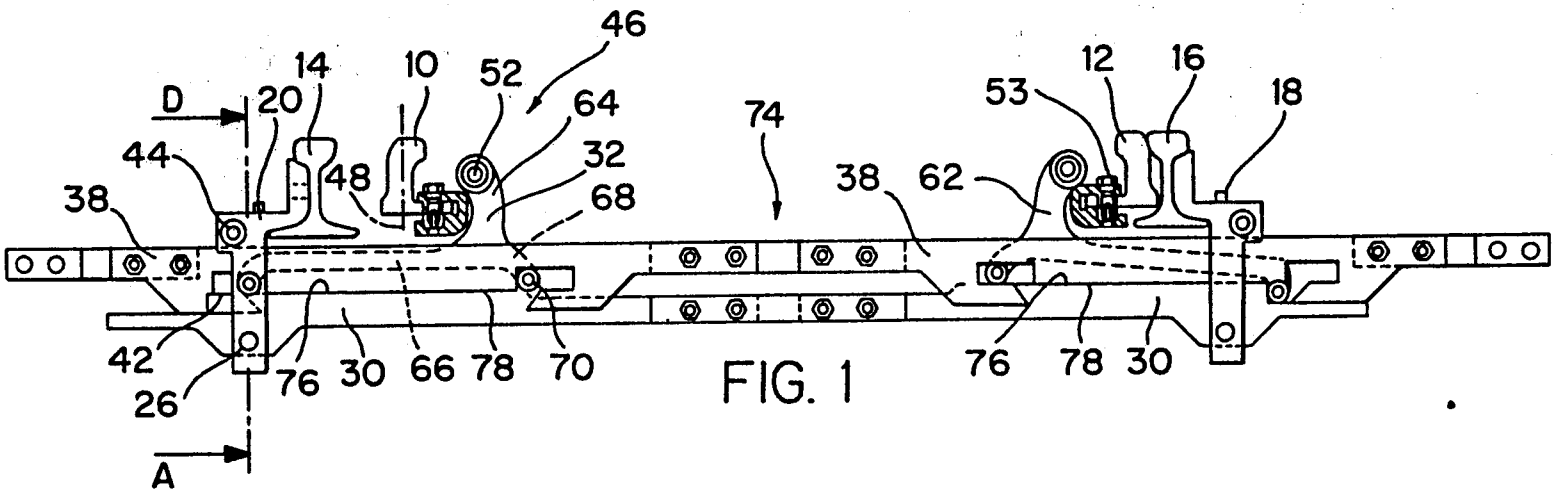

In addition, FIGS. 1 and 2 show that every switch blade (10) and (12) has an associated separate although similarly constructed slide (38) or support (30), respectively, and that these are connected to each other by means of fishplate connectors (74).

A change of length which can be affected by adjustment of the support (30) by means of the eccentric bushing (38) can be made through the slots that are provided in the area of the fishplate connector (74). Furthermore, these fishplate connectors can serve to insulate the halves of the support and the slide.

Figure 4:
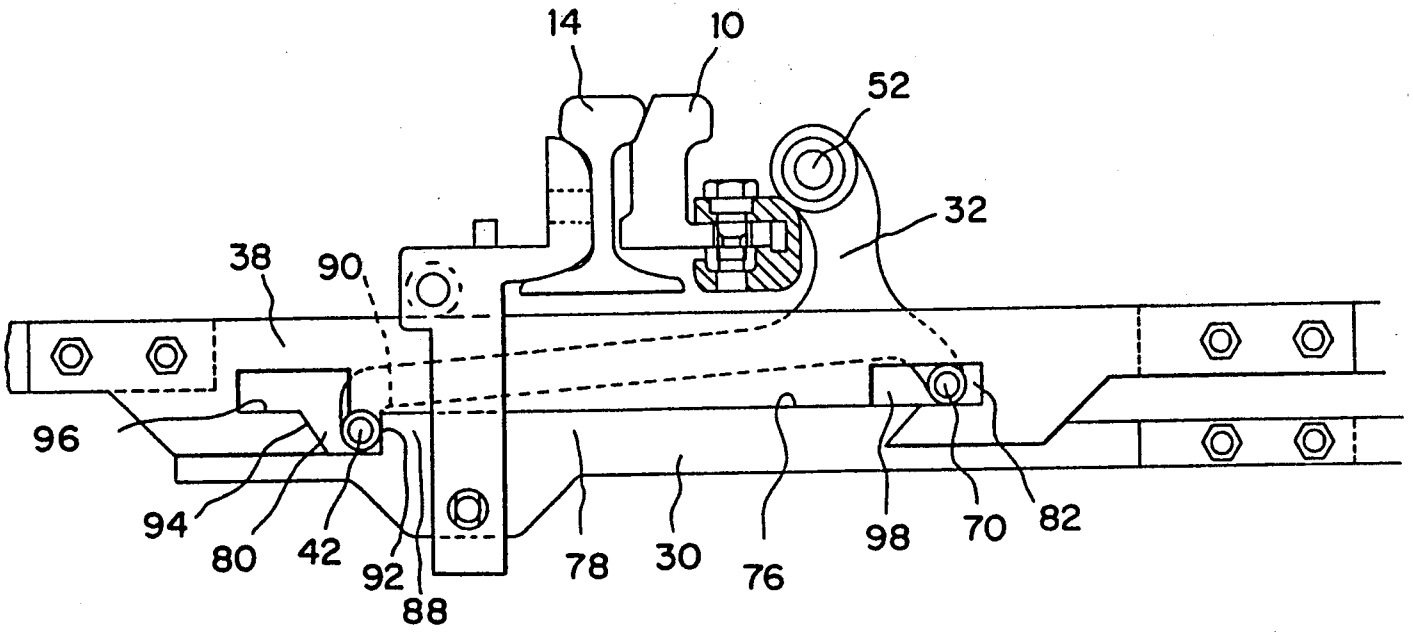

As is made clear, in particular, from FIG. 4, the support (30) and the slide (38), which is to say its parts (34)

and (36), have a horizontal section that runs in approximately the same plane, and which in relation to the slide is numbered (76) and in relation to the support (30) is numbered (78) (FIG. 4).

Outside these sections (76) and (78), the paths of the sections that run with the rollers (42) and (70) deviate from each other such that chamber-like notches (81), (82) (FIGS. 3 and 4) and (80), (86) (FIG. 5) are formed. The rollers (42) or (70), respectively, are then secured within these chambers if the switch rails (10) or (12), respectively, are locked or opened or moved between these limiting positions when raised; then, because of the construction according to the present invention, it is possible that the switch blade is lowered only in the end positions that are shown, by way of example, for the support surface (17), so that there is no need for any displacement along a slide chair, as is the case in known designs. This, too, results in a saving of lubricants.

FIG. 4 shows the switch blade (10) in the locked position. Here, the roller (42) that is on the side of the switch blade (10) relative to the axis of rotation of the locking clamp (32) is in a chamber (80), in which connection it is decisive that the roller (42) is secured to a step (88), and the switch blade (10) is held down. In this embodiment, the step (88) is made up of an upper horizontal section (90) and a vertical section (92). The section (90) is, in its turn, a front section of the horizontal section (76) of the slide (38) and the vertical section (92) is a section of the support (30). The roller (70) that is opposite is, in its turn, secured in the notch (82), which is formed at the top by a section of the slide and at the bottom both by a section of the support (30) and of the slide (38).

If the switch blade (10) is now to be unlocked, as is shown in the embodiment in FIG. 1 the slide (38) is moved to the right. The roller (42) is then held by a ramp-like section (94) of the slide (38), whereupon the locking clamp (32) is raised, which is to say rotated about the axis (52). At the same time, the switch blade (10) is raised. If the slide (38) is moved further to the right, the roller (42) moves onto the horizontal surface (96) of the notch (80) and the roller (70) moves into the area of the chamber (82) that is numbered (98). On further movement of the slide (38) to the right, the locking clamp (32) and thus the switch blade (10) are also moved to the right.

In the opened position, the roller (70) (FIG. 3) is in the area of an inclined surface (100) of the support (30). In this position, the switch blade (10) is lowered once again.

On locking, the roller (70) is once again raised by the ramp-like surface of the slide (38), and then moves along the surface (78).

Figure 3:
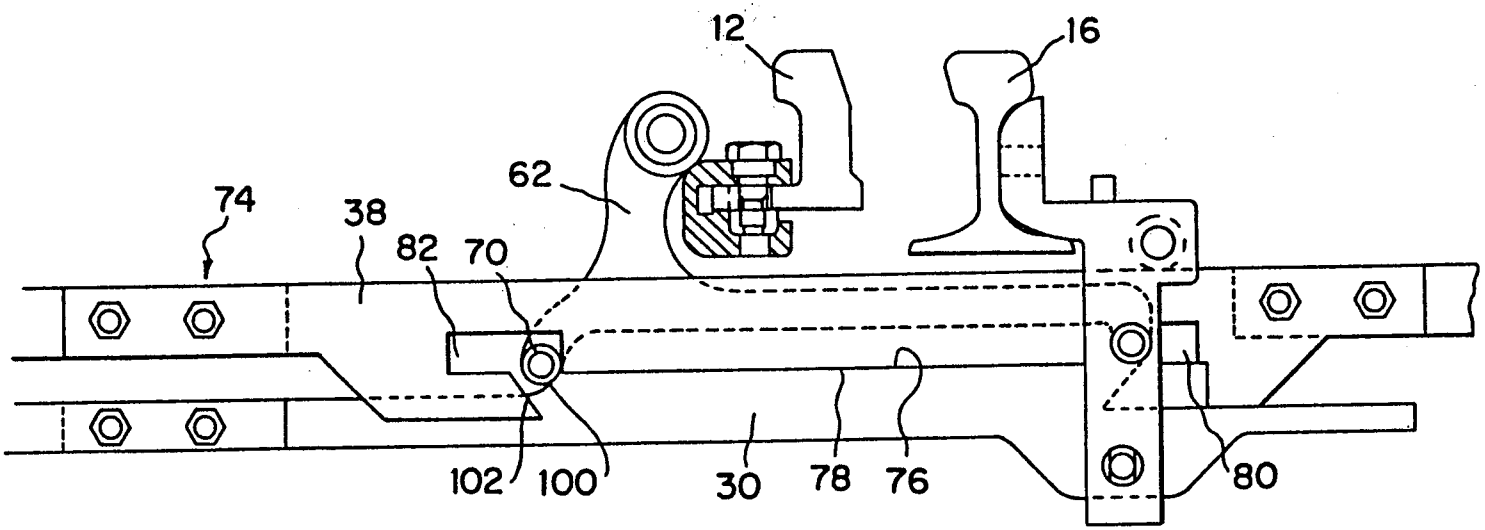
Figure 5:
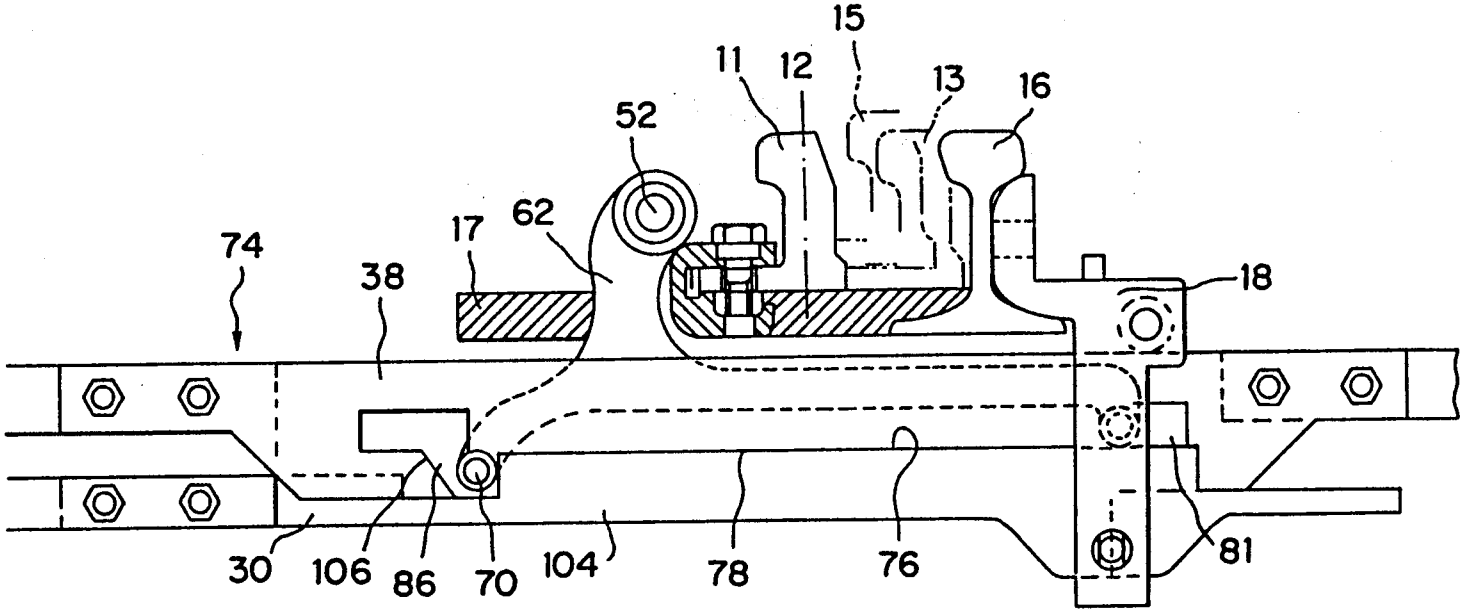
Figure 8:
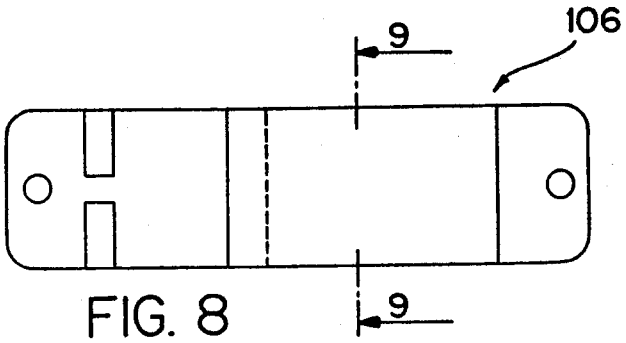

The embodiment shown in FIG. 5 differs from that shown in FIG. 3 to the effect that even in the opened position, the switch blade (10) is held down. In this position, the roller (70) is adjacent to a step, the action of which corresponds to that numbered (88) in FIG. 4. This step (104) that holds down the switch blade (12) in the opened position is formed on the rail side by a front section of the horizontal surface (76) of the slide (38), and in the vertical area by a section of the support (30). If the switch blade (12) is to be moved into the position where it is to be locked, the roller (70) is raised by a ramp-shaped section (106) of the slide (38), and as a result a sequence of movements is effected as described in connection with the embodiment shown in FIG. 4.

It can be seen that, because of the interaction of the elements that can slide in relation to each other, it is possible to save lubricants or even dispense with lubrication to a large extent (in particular in the case of rolling movement). Because of the formation of the notches and the associated raising and lowering of the rollers, it is ensured that the switch blades (10) and (12) have to be supported on a supporting surface (17) that is shown, purely by way of example in FIGS. 5 and 10 in their end positions only, which is to say in the locked and completely opened positions, in contrast to which, between these end positions, movement is effected in a raised position.

These different positions (support in the end position, and raising in the area between the opened or locked position, respectively) are shown in FIG. 5 by the drawing of the switch blade: the opened position of the switch blade (12) bears the reference number (11), the raised position bears the reference number (15), and the locked position bears the reference number (13).

Figure 10:
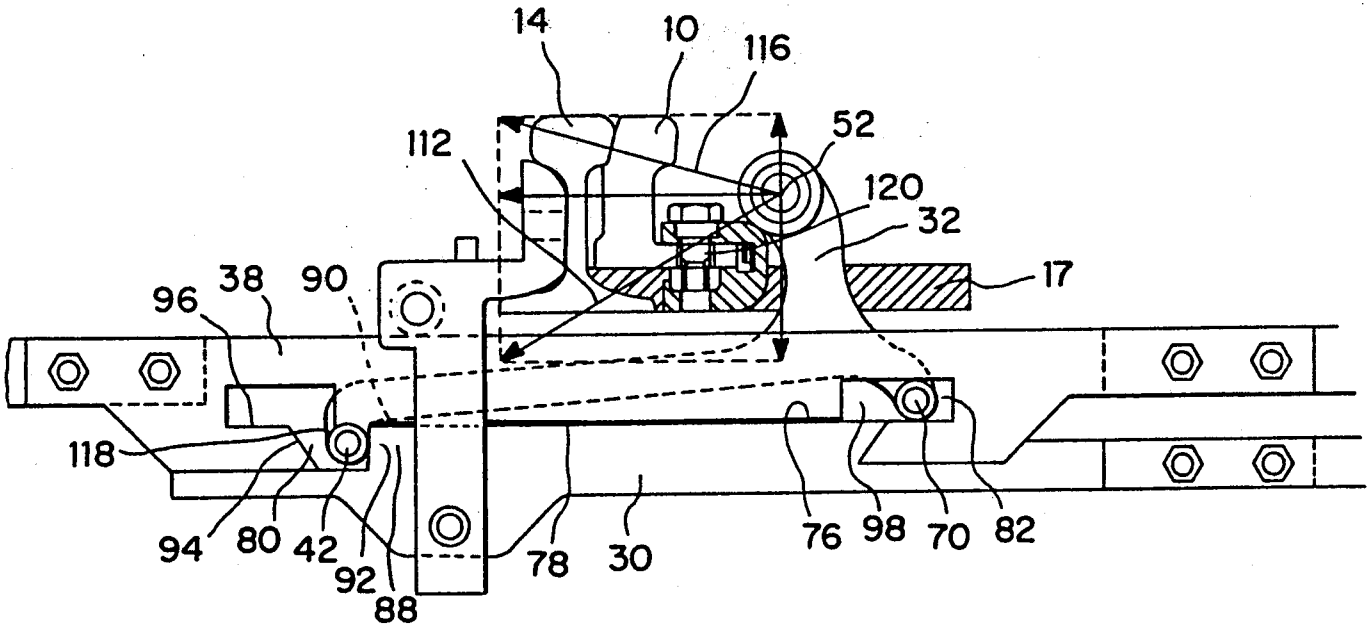

Finally, because of the path of the axis of rotation (52), a resultant force (arrow 53) in FIG. 1, and a vector (112) in FIG. 10 can be generated, by means of which when the switch blade (12) is locked, any twisting is prevented and the switch blade (12) is held down.

FIG. 10 once again shows the force vector or the resultant force that bring about the locking (112) and their components (114) and (116), in order to further clarify the concept of the present invention.

When the switch blade (10) is locked, the force vector (112) runs between the axis (52) about which the locking clamp (32) can be pivoted, and the supporting area (118) of the locking clamp (32) in the notch (80) which is to say, where the roller (42) is secured to the step (88). The magnitude and direction of the vector (112) between the axis (52) and the supporting area (118) are so selected that the vertical component (114) of the force intersects the foot (120) of the switch blade (10) or at least passes in the vicinity thereof, so that it is ensured that the switch blade (10) cannot tip, regardless of the magnitude of the force that is introduced through the locking clamp (32). Resultant force component (116) intersects the contact surface between the switch blade (10) and the stock rail (14) perpendicularly.

In order that the vertical component (114) which passes vertically through the base (17) or the slide chair intersects the rail foot (120) directly or else passes close to it, the axis (52) must be brought close to the switch blade (10). When this is done, the distance of the axis (52) from the proximate surface of the rib of the switch blade (10) is preferably 0.94 times the height of the switch blade (10). The axis (52) also lies at a distance above the surface of the base (17) which preferably corresponds to 0.56 times the height of the switch blade. In this case, the horizontal distance to the web can, if necessary, be increased by 50 mm or reduced by 20 mm, respectively. The distance to the slide chair can vary by ±20 mm. These figures apply basically to UIC rails that are 120 mm high.

Since, according to the present invention, movement of the switch blade on a support (106) is no longer necessary, according to an independently proposed solution it is foreseen that at least the supporting areas on which the switch blade is held down when in the end positions (locking, unlocking) is so configured that no dirt or fouling can stick to it.

Figure 9:
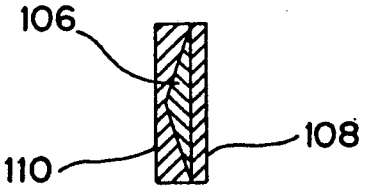

As is shown in the cross sectional drawing in FIG. 9, the unobstructed surface of the support (106) is inclined to the horizontal. In the embodiment shown, this is effected by means of a roof-shaped geometry (108). Supplemented, or at least partially supplemented, in a corresponding manner is the lower side (110) of the rail foot (120) of the switch blade (10) or (12), respectively, which thus has a V-shaped geometry in at least some sections. This geometry can be achieved by using an intermediate piece that must extend, at least in some areas, on the lower side of the switch blade. Other shapes such as a surface that is inclined only relative to the horizontal are also possible. The roof-shaped geometry results in the additional advantage of an automatic centering of the switch blade on the support (106).

We claim:

1. A device for locking a switch blade with a stock rail, the switch blade having a rail foot resting on a base, and said device comprising:

a lock piece connected with the stock rail and extending away from the stock rail;

a slide element that is reciprocally supported by said lock piece and adapted for movement between a switch blade locked position and a switch blade open position;

a locking element connected with the switch blade and said locking element being in contact with said slide element and dimensioned and arranged such that the rail foot is held in contact with the base when said switch blade is in said switch blade open and locked positions and is spaced away from the base for a period when the switch blade travels between said switch blade open and locked positions.

2. A device as recited in claim 1, further comprising a support (30) for the stock rail (14, 16) that is connected to said lock piece, and said device further including means for adjusting said support with respect to said lock piece.

3. A device as defined in claim 2, further comprising a bolt wherein said support includes an aperture into which said bolt extends, said bolt also extending into apertures formed in said lock piece (18, 20) and said means for adjusting including an eccentric bushing (39) being arranged between the bolt and the support.

4. A device as recited in claim 1 wherein said locking element comprises a locking clamp and a locking clamp receiver, said locking clamp receiver being secured to the switch blade and pivotably attached to said locking clamp about an axis extending parallel to the switch blade.

5. A device as defined in claim 4 further comprising a shaft and wherein said locking clamp is rotatable about said shaft and said shaft extends parallel to a longitudinal axis of the switch blade and is supported by said locking clamp receiver (56) that is connected to the switch blade, and said locking clamp being dimensioned and arranged so as to be displaceable along said longitudinal axis, and said device further comprising an elastic bushing (60) being arranged so as to be in contact with a section (58) of said locking clamp 932, 62) that surrounds the shaft (50).

6. A device as recited in claim 4 wherein said locking clamp receiver is rotatable with respect to said locking clamp about an axis that is positioned above the rail foot of the switch blade, and said locking clamp receiver includes a section which slopes downwardly and inwardly from said axis to the rail foot such that a downward vertical force component that develops when said slide element is in a switch blade locked position extends through the rail foot or in an area immediately adjacent the rail foot.

7. A device as recited in claim 1 further comprising a support extending parallel to said slide element and supported at one end by said lock piece, said locking element being adapted for movement with respect to said support and said slide element being relatively movable with respect to said locking element, said locking element including at least one supporting element which is dimensioned and arranged to interact reciprocally with said support and slide element so as to place the rail foot of the switch blade in contact with the base when the switch blade is in the open and locked positions and to lift the rail foot off of the base for a period during travel between said switch blade open and locked positions.

8. A device as recited in claim 7 wherein said slide element and said support each include a section which extends essentially horizontally and which lies essentially on a common plane, said slide element and said support each including additional sections extending away from each of said essentially horizontal sections, said additional sections being dimensioned and arranged so as to form chamber-like notches that secure said supporting element when said slide element is moved to said switch blade locked position.

9. A device as recited in claim 8 wherein said locking element includes two spaced apart supporting elements and said additional sections are dimensioned and arranged to form a pair of spaced apart chamber-like notches one above and one below the common plane, and said notches being dimensioned and arranged to secure respective ones of said spaced apart supporting elements.

10. A device as recited in claim 8 wherein said additional sections are dimensioned and arranged so as to secure said supporting element both when said slide element is in said switch blade open and locked positions.

11. A device as recited in claim 8 wherein said locking element includes a locking clamp from which said supporting element extends and a locking clamp receiver which is secured to the switch blade and pivotably attached to said locking clamp about an axis extending parallel to the switch blade, and wherein said additional sections are dimensioned and arranged such that when said slide element is in a switch blade locked position, said supporting element, which is positioned on a side of the switch blade in which said locking clamp receiver lies, is secured in a first chamber-like notch that comprises a step which holds down said supporting element, said step including a first of said additional sections and said first additional section forming a part of said slide element, and said step further includes a second of said additional sections and said second of said additional sections forming a part of said support, said first and second additional sections being at an angle with respect to each other such that said step defines a partially enclosed chamber that is formed about said supporting element.

12. A device as recited in claim 11 wherein said additional sections are dimensioned and arranged such that when said slide element is in said switch blade open position, a second supporting element of said locking element, positioned on an opposite side of the switch blade, is secured in a second chamber like notch that includes a step to hold down said second supporting element, said step of said second chamber-like notch including a third of said additional sections, said third additional section forming a part of said slide element, said step of said second chamber-like notch further including a fourth of said additional sections with said fourth additional section forming a part of said support, said third and fourth additional sections being arranged at an angle to one another such that said step of said second chamber-like notch defines a partially enclosed chamber.

13. A device for locking a switch blade with a stock rail, the switch blade having a rail foot supported on a base, and said device comprising:

a lock piece extending from the stock rail;

a locking element which comprises a locking clamp and a locking clamp receiver, said locking clamp receiver being secured to the switch blade and said locking clamp being pivotably attached to said locking clamp receiver;

a slide element extending through said lock piece and being dimensioned and arranged for reciprocal interaction with said locking element between a switch blade locked positioned and a switch blade open position;

a support extending from said lock piece and extending essentially parallel to said slide element, and said locking element being adapted for movement relative to said support and said slide element being adapted for movement relative to said locking element, and, when said slide element is in said switch blade locked position, said locking element is secured between said support and said slide element, and said device comprising a first roller element for providing rolling interaction between said locking element and said support and a second roller element for providing rolling interaction between said slide element and said lock piece.

* * * * *